US012102866B2

(12) United States Patent
Wang

(10) Patent No.: US 12,102,866 B2
(45) Date of Patent: Oct. 1, 2024

(54) COMBINABLE WEIGHT PLATE AND KETTLE BELL, DUMBBELL AND BARBELL USING THE WEIGHT PLATE

(71) Applicant: Shanxi Regent Works Inc., Shanxi (CN)

(72) Inventor: Zhi Wang, Shanxi (CN)

(73) Assignee: Shanxi Regent Works Inc., Shanxi (CN)

( * ) Notice: Subject to any disclaimer, the term of this patent is extended or adjusted under 35 U.S.C. 154(b) by 211 days.

(21) Appl. No.: 17/726,620

(22) Filed: Apr. 22, 2022

(65) Prior Publication Data

US 2023/0173327 A1 Jun. 8, 2023

Related U.S. Application Data

(63) Continuation of application No. PCT/CN2021/143572, filed on Dec. 31, 2021.

(30) Foreign Application Priority Data

Dec. 3, 2021 (CN) ..... 202111474486.9

(51) Int. Cl.
*A63B 21/072* (2006.01)
*A63B 21/06* (2006.01)

(52) U.S. Cl.
CPC ..... *A63B 21/0724* (2013.01); *A63B 21/06* (2013.01); *A63B 21/0726* (2013.01); *A63B 21/0728* (2013.01)

(58) Field of Classification Search
CPC ... A63B 21/00058–00065; A63B 21/06–0607; A63B 21/072–0783; A63B 21/08; A63B 2244/09
See application file for complete search history.

(56) References Cited

U.S. PATENT DOCUMENTS 6,776,741 B2 * 8/2004 Burwell ..... A63B 21/0728 482/106
7,037,245 B2 * 5/2006 Burwell ..... A63B 21/075 482/106

(Continued)

FOREIGN PATENT DOCUMENTS

CN 101199888 A 6/2008
CN 103357140 A 10/2013

(Continued)

OTHER PUBLICATIONS

First Office Action received in corresponding Chinese patent application No. 202111474486.9, dated Jun. 27, 2024, 16 pages.

(Continued)

*Primary Examiner* — Loan B Jimenez
*Assistant Examiner* — Kathleen M Fisk
(74) *Attorney, Agent, or Firm* — Cooper Legal Group, LLC

(57) ABSTRACT

The present application provides a combinable weight plate, which relates to the field of fitness equipment, and includes a plate body, a limiting assembly and an engaging assembly. The limiting assembly and the engaging assembly are arranged in the plate body. The engaging assembly is used to engage and connect the two plate bodies, and the limiting assembly is used to restrict the relative rotation of the two engaged and connected plate bodies. The present application also provides a weight adjustable kettle bell. The present application also provides a weight adjustable dumbbell. The present application also provides a weight adjustable barbell.

7 Claims, 9 Drawing Sheets

(56) References Cited

U.S. PATENT DOCUMENTS

| | | | | |
|---|---|---|---|---|
| 8,790,223 | B2 * | 7/2014 | Wang | A63B 21/075 482/106 |
| 9,084,913 | B2 * | 7/2015 | Davies, III | A63B 21/0728 |
| 9,095,743 | B2 * | 8/2015 | Davies, III | A63B 21/0728 |
| 9,555,281 | B2 * | 1/2017 | Beckman | A63B 21/0726 |
| 11,052,276 | B1 * | 7/2021 | Baker | A63B 21/0604 |
| 11,344,764 | B2 * | 5/2022 | Wang | A63B 21/4035 |
| 11,712,595 | B2 * | 8/2023 | Young | A63B 21/0724 482/107 |
| 2014/0287890 | A1 * | 9/2014 | Binder | A63B 21/0728 482/107 |
| 2017/0225025 | A1 | 8/2017 | Towley | |
| 2018/0264308 | A1 | 9/2018 | Wang | |
| 2022/0280829 | A1 * | 9/2022 | Gamboa | A63B 21/0728 |
| 2022/0387843 | A1 * | 12/2022 | Pasternak | A63B 21/4035 |
| 2023/0173327 | A1 * | 6/2023 | Wang | A63B 21/0724 482/107 |
| 2023/0285794 | A1 * | 9/2023 | Zhou | A63B 21/0726 |
| 2023/0356021 | A1 * | 11/2023 | Chen | A63B 21/0724 |

FOREIGN PATENT DOCUMENTS

| | | | |
|---|---|---|---|
| CN | 104368126 | A | 2/2015 |
| CN | 104524740 | A | 4/2015 |
| CN | 106955455 | A | 7/2017 |
| CN | 207640883 | U | 7/2018 |
| CN | 208591498 | U | 3/2019 |
| CN | 209092609 | U | 7/2019 |
| CN | 110694222 | A | 1/2020 |
| CN | 111035884 | A | 4/2020 |
| CN | 112587858 | A | 4/2021 |
| CN | 213031755 | U | 4/2021 |
| CN | 213252793 | U | 5/2021 |
| CN | 113694463 | A | 11/2021 |
| CN | 113713323 | A | 11/2021 |
| CN | 216366475 | U | 4/2022 |

OTHER PUBLICATIONS

Qu, X., "The Research and Development of the special dumbbell to the wrist and upper limbs strength training in ball project", Contemporary Sports Technology, 2013, 14 (3), pp. 4-5.

* cited by examiner

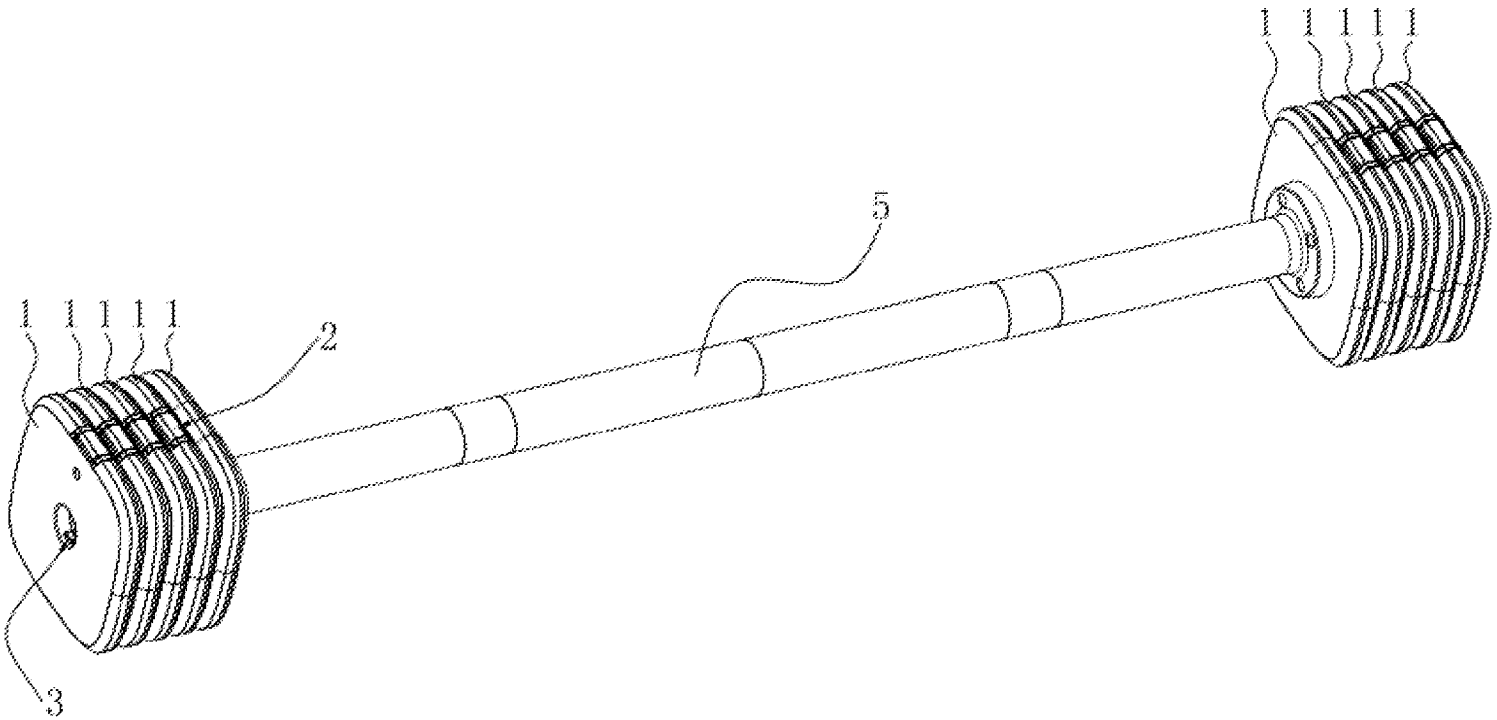
1
1
1

COMBINABLE WEIGHT PLATE AND KETTLE BELL, DUMBBELL AND BARBELL USING THE WEIGHT PLATE

CROSS-REFERENCE TO RELATED APPLICATION

This application is a continuation of international PCT application No. PCT/CN2021/143572, filed on Dec. 31, 2021, which claims a priority and benefit of China patent application No. 202111474486.9, filed on Dec. 3, 2021. The entireties of international PCT application No. PCT/CN2021/143572 and China patent application No. 202111474486.9 are hereby incorporated by reference herein and made a part of this specification.

TECHNICAL FIELD

The present application relates to the field of fitness equipment, and in particular, to a combinable weight plate and kettle bell, dumbbell and barbell using the weight plate.

BACKGROUND ART

In daily fitness, people usually use some fitness equipment. When exercising arm strength, people usually use a kettle bell, dumbbell or barbell to exercise arm strength by repeatedly lifting the kettle bell, dumbbell or barbell.

At present, a most commonly used kettle bell includes a grip and a kettle bell head, and the kettle bell head is fixedly connected to the bottom end of the grip. A dumbbell includes a dumbbell head and a dumbbell bar, two dumbbell heads are arranged symmetrically at both ends of the dumbbell bar in a length direction, and both dumbbell heads are fixedly connected to the dumbbell bar respectively. A barbell includes a barbell bar and a weight plate, a plurality of weight plates are symmetrically sleeved at both ends of the barbell bar, both ends of the barbell bar are threaded with nuts, and the weight plates are fixedly connected to the barbell bar with the nuts. In use, the user holds the grip, dumbbell bar or barbell bar, and repeatedly lifts the kettle bell, dumbbell or barbell.

In the prior art, since the kettle bell and the dumbbell have a single weight, users need to buy a plurality of kettle bells and dumbbells with different weights, and need to replace the weight plates of the barbell with nuts, all of which are not convenient for users.

SUMMARY

In order to facilitate use of kettle bells, dumbbells or barbells with different weights, the present application provides a combinable weight plate and kettle bell, dumbbell and barbell using the weight plate.

In the first aspect, a combinable weight plate according to the present application adopts the following technical solution.

A combinable weight plate, comprising: a plate body, a limiting assembly and an engaging assembly, wherein a circular central hole is formed on one side of the plate body, the engaging assembly comprises a fixture block and a cylindrical engaging head, the fixture block is fixedly arranged on an inner wall of the central hole, the engaging head is fixedly connected on a side of the plate body away from the central hole, and an engaging block corresponding to the fixture block is fixedly arranged on a side wall of the engaging head, the engaging head is used to be inserted into a central hole of an adjacent weight plate, and when the engaging head rotates in the central hole of the adjacent weight plate, the engaging head abuts on a side of the fixture block, facing interior of the central hole, by means of the engaging block;

the limiting assembly comprises a sliding block, wherein the sliding block is slidably arranged in the plate body along a thickness direction of the plate body, a limiting block protruding from a side wall of the plate body is fixedly arranged at one end of the sliding block in a sliding direction, an engaging groove for engaging with the limiting block is formed on one side of the plate body away from the limiting block, the plate body is arranged with an elastic part, and the limiting block engages in the engaging groove of the adjacent weight plate all the time by means of the elastic part when a combinable weight plate is connected to the adjacent weight plate.

In the above technical solution, in use, one side of a plate body on which an engaging head is arranged abuts against one side of another plate body on which arranged a central hole is formed, and an engaging block of the one plate body is stagger with a fixture block of the other plate body, thereby the engaging head of one plate body is able to insert into the central hole of the other plate body; and then the engaging head of one plate body rotates until the engaging block directly faces the fixture block, thereby the engaging block engages with the fixture block. At the same time, because one side of a plate body on which an engaging head is arranged abuts against one side of another plate body on which arranged a central hole is formed, the limiting block slides into the plate body and compresses the elastic part. With the rotation of the plate body, when the engaging block directly faces the fixture block, the limiting block also directly faces the engaging groove. The sliding block is pushed by the elastic force of the elastic part, the sliding block drives the limiting block to slide into the engaging groove, thereby the limiting block engages in the engaging groove, thereby one plate body can be detachably connected to another plate body by engaging of the engaging block with the fixture block and engaging of the limiting block with the engaging groove, and a plurality of plate bodies can be combined together in the same way. When it is necessary to remove a plate body, the limiting block slides into the plate body, then the plate body rotates such that the engaging block is stagger with the fixture block, and adjacent two plate bodies can be separated. A plurality of plate bodies may be disassemble in the same way, thereby adjacent two weight plates can be assembled and disassembled conveniently.

In some embodiments, a button is slidably connected to the plate body, a sliding direction of the button is perpendicular to a sliding direction of the sliding block, one end of the button in the sliding direction is arranged in the plate body, the other end extends out of a side wall of the plate body, an end of the button close to the sliding block forms an inclined surface and abuts against the sliding block, and when the button slides towards the sliding block, the button pushes the sliding block to slide towards an end away from the limiting block.

In the above technical solution, with sliding of the button toward a direction close to the sliding block, since position at which the button abuts against the sliding block is an inclined plane that is inclined towards a side close to the limiting block along a direction close to the sliding block, the sliding block is pushes by the inclined plane of the button to slide during the sliding process, thereby the limiting block on the sliding block slides into the plate body. Thus, the sliding block is pushed to slide by the inclined plane of the button. Thereby the process of the sliding block driving the limiting block to slide into the plate body is more conveniently and quickly.

In some embodiments, the elastic part comprises a first spring and a second spring, the first spring is fixedly arranged between the sliding block and the plate body, and the first spring is arranged along the sliding direction of the sliding block, the second spring is fixedly arranged between the button and the plate body, and the second spring is arranged along the sliding direction of the button.

In the above technical solution, by pressing the button, the button slides towards a direction close to the sliding block, which compress the second spring at the same time. In the process of button sliding, the sliding block is pushed to slide by the inclined plane abutting against the sliding block, and thus compress the first spring at the same time, thereby the sliding block drives the limiting block to slide into the plate body, and adjacent two plate bodies can rotate relative to each other. When the limiting block directly face the engaging groove, by releasing the button, the button slides away from the sliding block under the elastic force of the second spring. At the same time, the sliding block drives the limiting block to slide under the elastic force of the first spring until the limiting block completely engages into the engaging groove, such that the movements of the sliding block and the button are more conveniently and quickly. After pushing the sliding block by the button, the button and sliding block can be reset automatically, which makes it easier and faster to assemble or disassemble one plate body with another. Under the elastic force of the first spring, the sliding block can stably engage the limiting block into the engaging groove, thereby the limiting block is not easy to disengage from the engaging groove.

In some embodiments, a button is slidably connected to the plate body, a sliding direction of the button is perpendicular to a sliding direction of the sliding block, one end of the button in the sliding direction is arranged in the plate body, the other end extends out of a side wall of the plate body, a sliding slot is formed in the button, an end of the sliding slot close to the sliding block is inclined towards a side close to the limiting block, a cylindrical pin is slidably connected in the sliding slot, the cylindrical pin is fixedly connected to the sliding block, the elastic part comprises a first spring that is fixedly arranged between the button and the plate body, and the first spring is arranged along the sliding direction of the button.

In the above technical solution, the button slides toward a direction close to the sliding block and compresses the first spring at the same time, the cylindrical pin in the sliding slot slides along the inclined direction of the sliding slot, the cylindrical pin drives the sliding block to slide, and the sliding block drives the limiting block to slide into the plate body, thereby the sliding block is pushed to slide by the sliding slot of the button. The process in which the sliding block drives the limiting block to slide into the plate body is more conveniently and quickly. At the same time, after releasing the button, the button and slide body can return to their original position under the elastic force of the first spring, making the movement of the button and the sliding block more conveniently and quickly.

In some embodiments, a plurality of fixture blocks are arranged along a circumferential direction of the central hole, a plurality of engaging blocks are arranged along a circumferential direction of the engaging head, the plurality of engaging blocks is in one-to-one correspondence with the plurality of fixture blocks, and an engaging block is able to pass through a gap between two adjacent fixture blocks.

In the above technical solution, by setting a plurality of fixture blocks and a plurality of engaging blocks in one-to-one correspondence with the fixture blocks, the engaging of two adjacent plate bodies is more stable, the connection strength of two plate bodies is improved, and two adjacent plate bodies in the engaging state are not easy to be separated.

In some embodiments, each of both sides of the button extends in the sliding direction to form a protrusion, a stop block corresponding to a protrusion is fixedly arranged on each of two sides, along the sliding direction of the button, of the plate body, and the stop blocks abut against on sides of the protrusions away from the sliding block.

In the above technical solution, the stop block and the protrusion cooperate to limit the sliding stroke of the button, thereby the button is not easy to disengage from the plate body, thereby the button can slide stably in the plate body.

In some embodiments, guide grooves are formed on both sides of the sliding block in the sliding direction, the guide grooves extend through two end faces of the sliding block in the sliding direction, a guide block is arranged in each of the guide grooves, the guide blocks are fixedly arranged on the plate body, and the sliding blocks are slidably connected to the guide blocks.

In the above technical solution, the sliding process of the sliding block in the plate body is more stable through the cooperation of the guide groove and the guide block, thereby the sliding direction of the sliding block is not easy to change.

In the second aspect, the present application provides a kettle bell with adjustable weight, which adopts the following technical solution:

a kettle bell with adjustable weight includes a grip and the weight plate as mentioned above, a plurality of the weight plates are arranged along a thickness direction of the weight plate, two adjacent weight plates are detachably connected with each other by the limiting assembly and the engaging assembly, and the grip is fixedly connected to a weight plate at edge.

In the above technical solution, the weight plate is fixedly connected to the grip, and a plurality of weight plates can be detachably connected on a side of the weight plate away from the grip by the limiting assembly and the engaging assembly, thereby realize the convenient adjustment of the weight of the kettle bell, thereby the user can easily adjust the weight of the kettle bell and make the use of the kettle bell more conveniently and quickly, and there is no need to buy a plurality of kettle bells of different weights.

In the third aspect, the present application provides a dumbbell with adjustable weight, which adopts the following technical solution:

a dumbbell with adjustable weight includes a dumbbell bar and the weight plate as mentioned above, a plurality of the weight plates are arranged along a length direction of the dumbbell bar and symmetrically arranged at both ends of the dumbbell bar in the length direction, two weight plates at both ends of the dumbbell bar in a length direction are fixedly connected to the dumbbell bar, and two adjacent weight plates are detachably connected with each other by the limiting assembly and the engaging assembly.

In the above technical solution, firstly, two weight plates are fixedly connected to both ends of the dumbbell bar, and a plurality of weight plates can be detachably connected on a side where the two weight plates are far away from each other through the limiting assembly and the engaging assembly, thereby realize the convenient adjustment of dumbbell weight, and then facilitate the user to adjust the weight of dumbbell, making the use of dumbbell more conveniently and quickly, and there is no need to buy a plurality of dumbbells of different weights.

In the fourth aspect, the present application provides a barbell with adjustable weight, which adopts the following technical solution:

a barbell with adjustable weight includes a barbell bar and the weight plate as mentioned above, a plurality of the weight plates are arranged along a length direction of the barbell bar and symmetrically arranged at both ends of the barbell bar in a length direction, two weight plates at both ends of the barbell bar in the length direction are fixedly connected to the barbell bar, and two adjacent weight plates are detachably connected with each other by the limiting assembly and the engaging assembly.

In the above technical solution, firstly, two weight plates are fixedly connected to both ends of the barbell bar, and a plurality of weight plates can be detachably connected on a side where the two weight plates are far away from each other through the limiting assembly and the engaging assembly, thereby realize the convenient adjustment of the barbell weight, and then facilitate the user to adjust the barbell weight, making the use of the barbell more conveniently and quickly.

In the fifth aspect, the present application provides a fitness equipment with adjustable weight, which adopts the following technical solution:

a fitness equipment with adjustable weight includes the combinable weight plate in the first aspect. In some embodiments, the fitness equipment is selected from any one of a kettlebell, a dumbbell, and a barbell.

To sum up, the present application achieves at least one of the following beneficial technical effects.

1. By setting the engaging assembly and the limiting assembly on the plate body, the two plate bodies can be assembled quickly through the engaging assembly and the limiting assembly.
2. By combining a plurality of weight plates on the grip, the weight of the kettle bell can be adjusted conveniently, thereby the user can use the kettle bell more conveniently and quickly without purchasing a plurality of kettle bells with different weights.
3. By combining a plurality of weight plates on the dumbbell bar, the weight of the dumbbell can be adjusted conveniently, thereby the user can use the dumbbell more conveniently and quickly without purchasing a plurality of dumbbells with different weights.
4. By combining a plurality of weight plates on the barbell bar, the weight of the barbell can be adjusted conveniently, thereby the users can use the barbell more conveniently and quickly.

BRIEF DESCRIPTION OF THE DRAWINGS

FIG. 9 is a structural diagram of the barbell of the present application.

DETAILED DESCRIPTION

The present application is further described in detail below with reference to FIGS. 1-9.

An embodiment of the present application provides a combinable weight plate.

Embodiment 1

Figure 1:
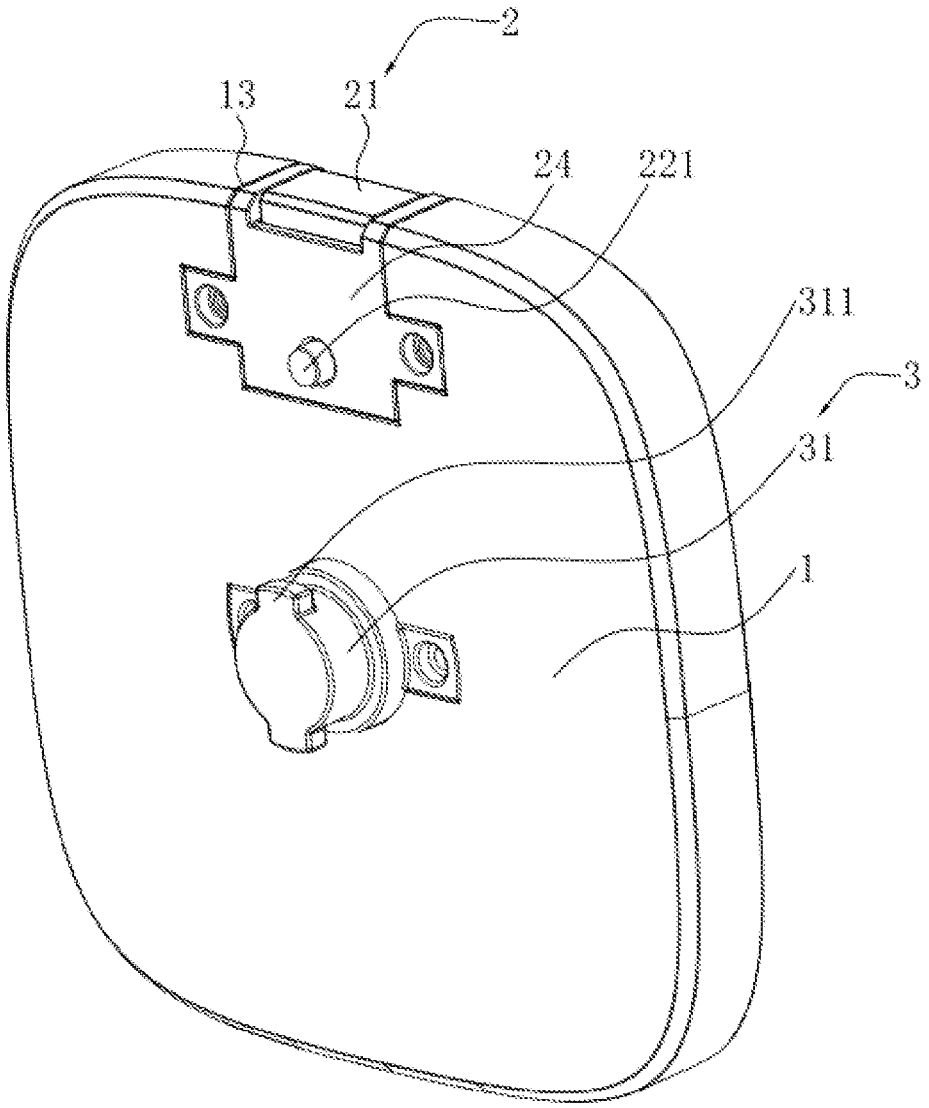
FIG. 1 is a structural diagram of the weight plate according to Embodiment 1 of the present application.

Referring to FIG. 1, a combinable weight plate includes a plate body 1, a limiting assembly 2 and an engaging assembly 3. The limiting assembly 2 and the engaging assembly 3 are both arranged in the plate body 1. Two plate bodies 1 are engaged with each other by the engaging assembly 3. The limiting assembly 2 is used to limit a relative rotation of two plate bodies 1 that are engaged together. In use, two plate bodies 1 are engaged with each other by the engaging assembly 3, and the two plate bodies 1 are difficult to rotate relative to each other by means of the limiting assembly 2, thereby the two weight plates are easy to assemble and disassemble.

Figure 2:
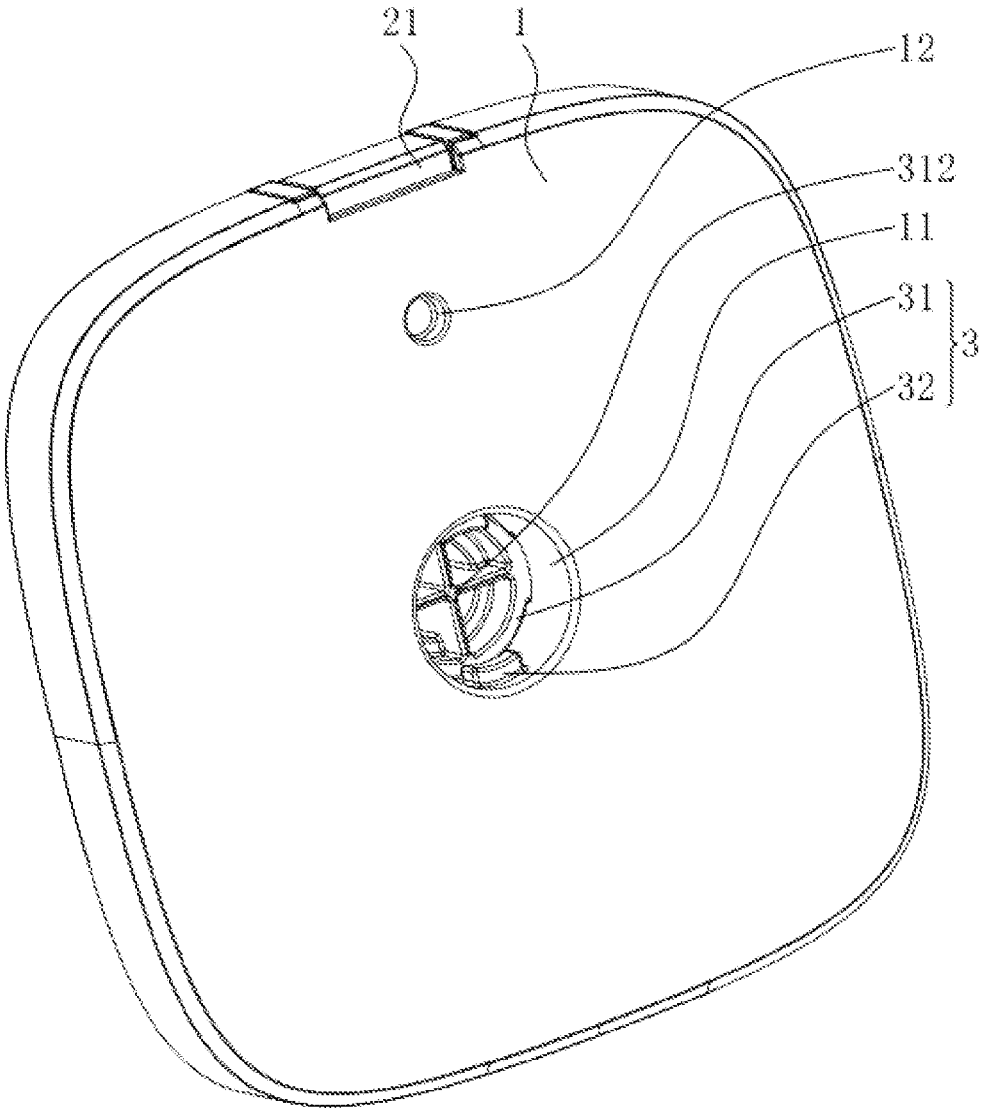
FIG. 2 is a structural diagram of another angle of the weight plate according to Embodiment 1 of the present application.

Referring to FIGS. 1 and 2, the plate body 1 is in a rectangular plate shape, a circular central hole 11 is provided at the center of the plate body 1, and the central hole 11 extends through the thickness of the plate body 1. The engaging assembly 3 includes an engaging head 31 and a fixture block 32. The engaging head 31 is in a cylindrical shape, one end of the engaging head 31 in an axial direction is arranged in the central hole 11, and the engaging head 31 is fixedly connected to the plate body 1. A stiffener 312 in a cross shape is fixedly arranged on the inner wall of the engaging head 31, and the engaging head 31 inserts into central holes 11 of adjacent weight plates.

Referring to FIGS. 1 and 2, a plurality of engaging blocks 311 are circumferentially fixed on an outer side wall of one end, outside the central hole 11, of the engaging head 31. One end, away from the engaging head 31, of the engaging block 311 fits with the inner wall of the central hole 11. A plurality of fixture blocks 32 are circumferentially arranged on an inner wall of one end, away from the engaging head 31, of the central hole 11. The fixture blocks 32 are integrally connected or detachably fixed with the plate body 1. The fixture blocks 32 are in one-to-one correspondence with the engaging blocks 311. One end of a fixture block 32 away from the inner wall of the central hole 11 fits with the outer side wall of the engaging head 31.

Referring to FIGS. 1 and 2, a gap is reserved between two adjacent fixture blocks 32, and the engaging block 311 can extend through a gap between two adjacent fixture blocks 32. When the engaging head 31 rotates in a central hole 11 of an adjacent weight plate, the engaging head 31 abuts on a side of the fixture block 32, facing the interior of the central hole 11, by means of the engaging block 311.

In use, an engaging block 311 of one plate body 1 is staggered with a fixture block 32 of another plate body 1, and then the engaging block 311 passes through a gap between adjacent fixture blocks 32; after the engaging block 311 completely extends through the fixture block 32, the engaging head 31 is rotated until the engaging block 311 is aligned directly with the fixture block 32, thereby the engaging head 31 is inserted into the central hole 11. In this way, the engaging block 311 and the fixture block 32 are in an engaging state, thereby an engaging connection of two plate bodies 1 can be realized by means of the engaging assembly 3.

Figure 3:
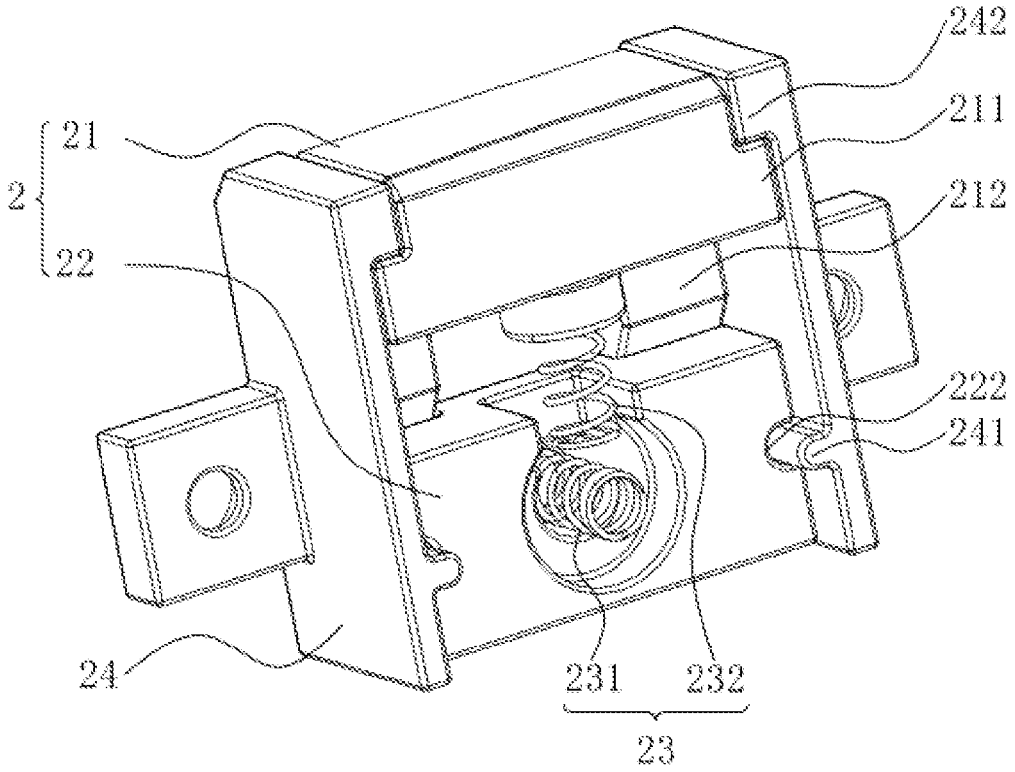
FIG. 3 is a structural diagram of the weight plate according to Embodiment 1 of the present application, to illustrate the limiting assembly.

Referring to FIGS. 1 and 3, a limit groove 13 is formed on one side of the plate body 1 close to the engaging head 31, the limit groove 13 extends through one side of the plate body 1 in a thickness direction, and the limit groove 13 is rectangular. A limit cover 24 is inserted into the limit groove 13. The limit cover 24 is fixedly connected to the plate body 1. The limit cover 24 is rectangular columnar and hollow inside. A length direction of the limit cover 24 is the same as that of the limit groove 13. One side, close to the bottom of the limit groove 13 in a length direction, of the limit cover 24 is open, and one end, close to the center of the plate body 1 in a length direction, of the limit cover 24 is open.

Figure 4:
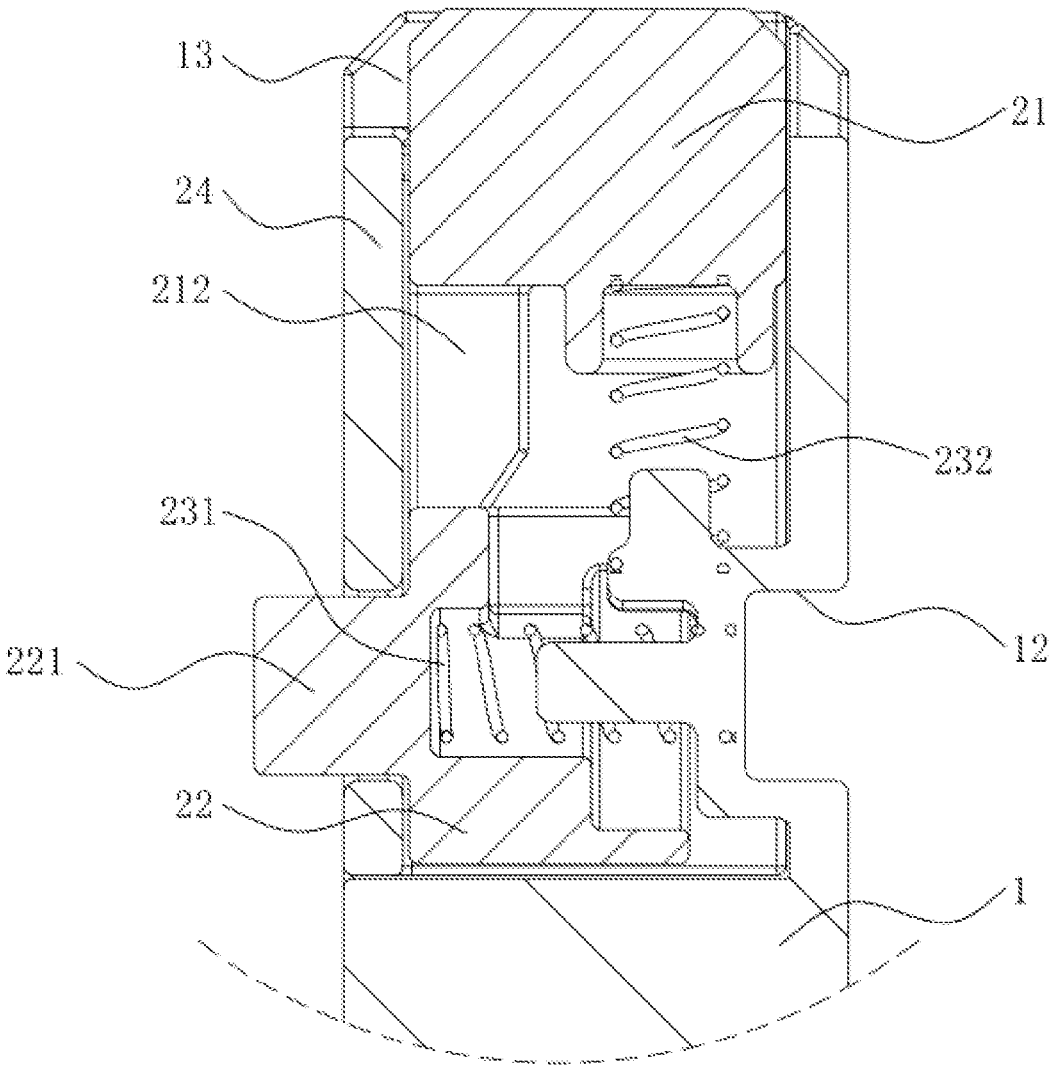
FIG. 4 is a sectional view of the weight plate according to Embodiment 1 of the present application, to illustrate the assembly relationship of the limiting assembly.

Referring to FIGS. 3 and 4, the limiting assembly 2 includes a sliding block 22 and a button 21. The sliding block 22 is a rectangular block and is arranged in the limit cover 24. The sliding block 22 is slidably connected to the limit cover 24 along a thickness direction of the plate body 1. A guide groove 222 is formed on both sides of the sliding block 22 in a sliding direction, the guide groove 222 is in a semicircular arc, and the guide groove 222 extends through the two end faces of the sliding block 22 in the sliding direction. A guide block 241 is arranged in the guide groove 222, the guide block 241 is in a semicircular columnar and is fixedly connected to the limit cover 24. The plate body 1 is arranged with an elastic part 23, the elastic part 23 includes a first spring 231 that is fixedly arranged between the sliding block 22 and the plate body 1 along the sliding direction of the sliding block 22.

Referring to FIG. 4, a limiting block 221 is fixedly provided at one end of the sliding block 22 close to the limit cover 24, the limiting block 221 is cylindrical, and the limiting block 221 penetrates through the limit cover 24 and is slidably connected to the limit cover 24. An engaging groove 12, which fits to the limiting block 221, is provided on a side of the plate body 1 away from the limiting block 221, and the engaging groove 12 is used to engage with the limiting block 221.

In use, after two plate bodies 1 are engaged with each other by means of the engaging assembly 3, the limiting block 221 of one plate body 1 can stably engage in the engaging groove 12 of the other plate body 1 under the action of the first spring 231, and thus the two plate bodies 1 are unable to rotate relative to each other. When it is necessary to remove a plate body 1, by sliding the sliding block 22 to drive the limiting block 221 to disengage from the engaging groove 12, the plate body 1 to be removed can rotate relative to another plate body 1; when the engaging block 311 of the plate body 1 to be taken is misaligned with the fixture block 32 of the other plate body 1, the plate body 1 to be taken can be separated with another plate body 1.

Referring to FIGS. 3 and 4, the button 21 is arranged in the limit cover 24 and on a side of the sliding block 22 away from the center of the plate body 1. The button 21 is slidably connected with the limit cover 24. A sliding direction of the button 21 is the same as a length direction of the limit cover 24. The button 21 is in a rectangular block, and one end of the button 21 away from the sliding block 22 penetrates through the limit cover 24.

Referring to FIGS. 3 and 4, each of both sides of the button 21 in a sliding direction extends to form a protrusion 211. Each protrusion 211 is arranged on a side of the limit cover 24 close to the sliding block 22, a stop block 242 corresponding to the protrusions 211 is fixedly arranged on both sides of the limit cover 24 along the sliding direction of the button 21, and the protrusion 211 and the stop block 242 abut against on a side close to each other. The elastic part 23 further includes a second spring 232, which is fixedly arranged between the button 21 and the plate body 1, and the second spring 232 is arranged along the sliding direction of the button 21.

Figure 5:
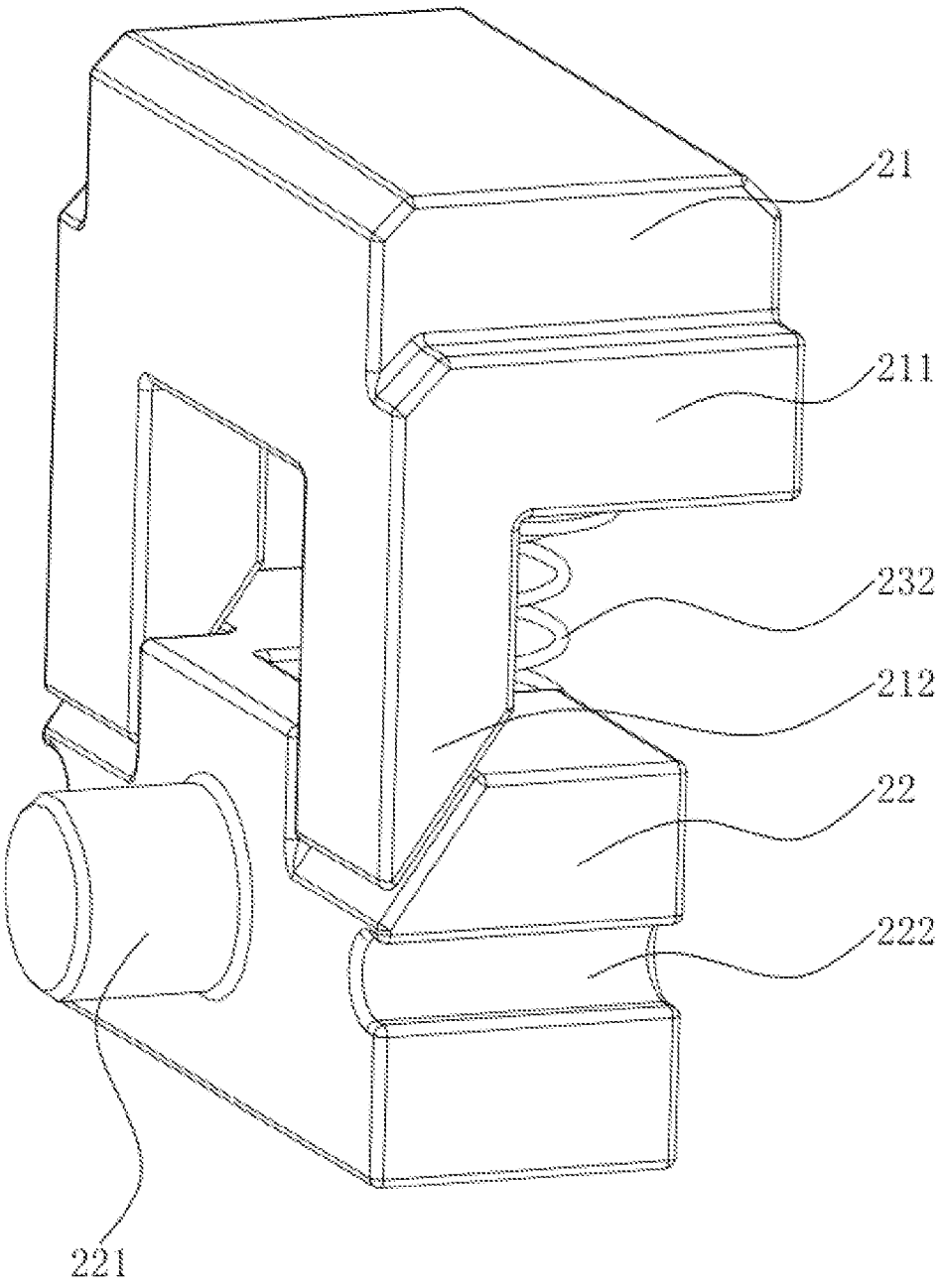
FIG. 5 is a structural diagram of the weight plate according to Embodiment 1 of the present application, to illustrate the assembly relationship between the sliding block and the button.

Referring to FIG. 5, the button 21 extends toward the sliding block 22 to form two push blocks 212. The two push blocks 212 are symmetrically arranged on both sides of the button 21 in the sliding direction. The two push blocks 212 are arranged on a side of the button 21 close to the limiting block 221, and one end of the push block 212 close to the sliding block 22 is inclined towards a side close to the limiting block 221 in a direction close to the sliding block 22, one end of the sliding block 22 close to the push block 212 is inclined towards a side away from the limiting block 221 along a direction close to the push block 212, and the sliding block 22 abuts against and fits with the inclined end close to the push block 212.

In use, after two plate bodies 1 engage with each other by means of the engaging assembly 3, the limiting block 221 of one plate body 1 remains in the engaging state with the engaging groove 12 of another plate body 1 under the action of the first spring 231; the protrusions 211 of the button 21 keeps in an abutting state with the stop block 242 of the limit cover 24 under the action of the second spring 232; by pressing the button 21 and compressing the second spring 232 at the same time, the button 21 slides in a direction close to the sliding block 22; at the same time, the sliding block 22 is pushed to slide by means of the inclined plane abutted between the push block 212 and the sliding block 22; at the same time, the first spring 231 is compressed such that the limiting block 221 disengages with the engaging groove 12; the sliding block 22 is pushed by the button 21, thereby the process of the sliding block 22 driving the limiting block 221 disengaging the engaging groove 12 is more conveniently and quickly. After releasing the button 21, the button 21 can automatically return to its original position under the elastic force of the second spring 232, and the sliding block 22 can automatically return to its original position under the elastic force of the first spring 231, thereby the button 21 can automatically reset after pushing the sliding block 22, making the process of pushing the sliding block 22 by the button 21 more conveniently and quickly.

The implementation principle of Embodiment 1 is as follows: in use, pressing the button 21 of one plate body 1 to slide the limiting block 221 into the limit cover 24, compressing the first spring 231 and the second spring 232, the engaging block 311 of one plate body 1 is staggered from the fixture block 32 of another plate body 1, thereby the engaging head 31 of one plate body 1 can be inserted into the central hole 11 of another plate body 1; rotating one plate body 1 until the engaging block 311 of one plate body 1 faces the fixture block 32 of the other plate body 1, and then releasing the button 21 of one plate body 1; the button 21 is reset under the action of the second spring 232, while the sliding block 22 is reset under the action of the first spring 231, and the sliding block 22 drives the limiting block 221 to slide out of the limit cover 24, the limiting block 221 of one plate body 1 engages in the engaging groove 12 of the other plate body 1, and then a plurality of weight plates are assembled in the same way. When removing the plate body 1, by pressing the button 21 of the plate body 1 to be taken, the limiting block 221 of the plate body 1 to be taken slides into the limit cover 24; and then by rotating the plate body 1 to be taken, when the engaging block 311 of the plate body 1 to be taken staggers with a fixture block 32 with which the engaging block 311 of the plate body lengages, the plate body 1 to be taken can be removed, thereby realizing the convenient assembly and disassembly of two adjacent plate bodies 1.

Embodiment 2

Figure 6:
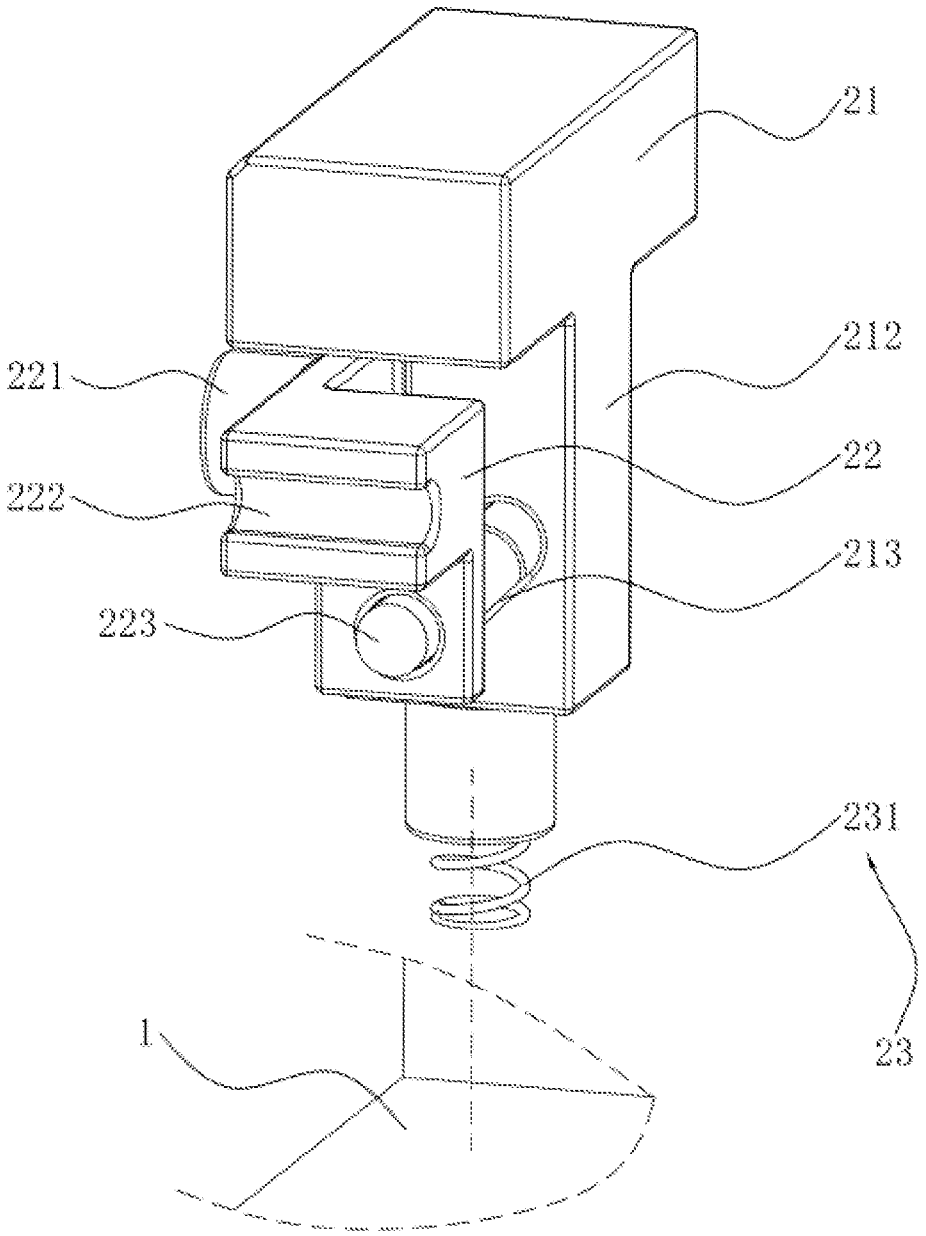
FIG. 6 is a structural diagram of the weight plate according to Embodiment 2 of the present application, to illustrate the assembly relationship between the sliding block and the button.

Referring to FIG. 6, this embodiment differs from the Embodiment 1 is in that, the button 21 extends toward the sliding block 22 to form one push blocks 212. The push block 212 is arranged a side of the button 21 away from the limiting block 221, and a sliding slot 213 is formed in one end of the push block 212 away from the button 21. The sliding slot 213 extends through both sides of the push block 212 in a sliding direction, and a depth direction of sliding slot 213 is perpendicular to the sliding direction of button 21 and sliding block 22. The sliding slot 213 is inclined towards a side, close to the limiting block 221, in a direction of the button 21 close to the sliding block 22. A cylindrical pin 223 is slidably connected in the sliding slot 213, both ends of the cylindrical pin 223 extend through the sliding slot 213, and both ends of the cylindrical pin 223 are fixedly connected with the sliding block 22. The elastic part 23 includes a first spring 231, which is fixedly arranged between the push block 212 and the plate body 1, and the first spring 231 is arranged along the sliding direction of the button 21.

In use, by pressing the button 21, the button 21 slides in a direction close to the sliding block 22 and compresses the first spring 231 at the same time, the sliding slot 213 in an button 21 moves as the button 21 to drive the cylindrical pin 223 to move from an end of the sliding slot 213 close to the limiting block 221 to an end of the sliding slot 213 away from the limiting block 221. The cylindrical pin 223 drives the sliding block 22 to slide, the sliding block 22 drives the limiting block 221 to slide. When the button 21 is released, the button 21 is reset under the elastic force of the first spring 231. At the same time, the button 21 drives the sliding slot 213 to reset the cylindrical pin 223, and the cylindrical pin 223 drives the sliding block 22 and the limiting block 221 to reset.

The embodiment of the present application also discloses a weight adjustable kettle bell.

Figure 7:
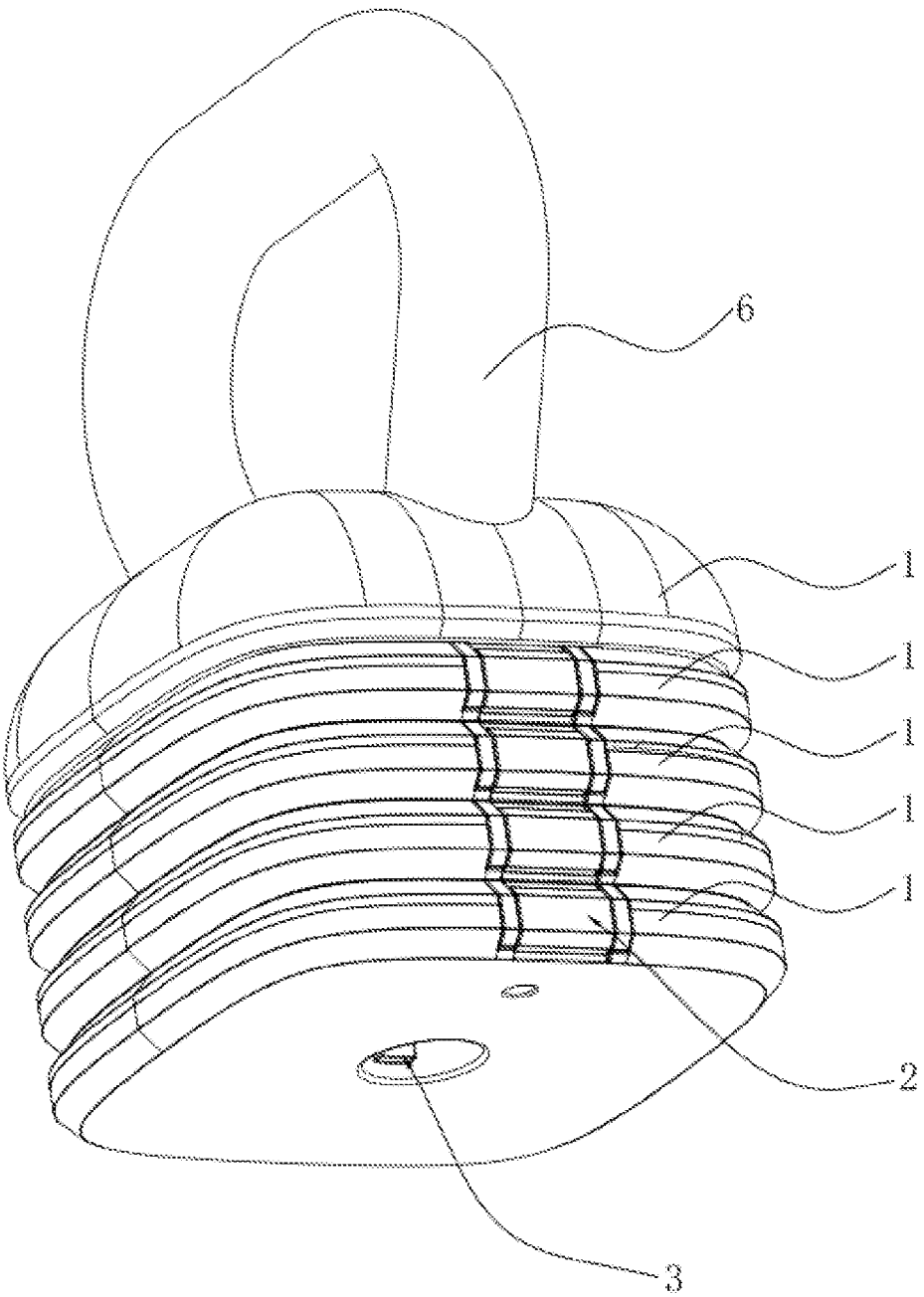
FIG. 7 is a structural diagram of the kettle bell of the present application.

Referring to FIG. 7, a weight adjustable kettle bell includes a grip 6 and the weight plate described above, a plurality of weight plates are arranged along itself thickness direction, the two adjacent weight plates are detachably connected through a limiting assembly 2 and an engaging assembly 3, and the bottom end of the grip 6 is fixedly connected with the weight plate at the most edge.

In use, the weight plate is fixedly connected to the bottom end of the grip 6, and then a plurality of weight plates are detachably connected to the weight plate at the bottom end of the grip 6 through the limiting assembly 2 and the engaging assembly 3, thereby the weight of the kettle bell can be adjusted, which is convenient for the user to adjust the weight of the kettle bell, thereby the user does not need to buy a plurality of kettle bells with different weights.

The embodiment of the present application also discloses a dumbbell with adjustable weight.

Figure 8:
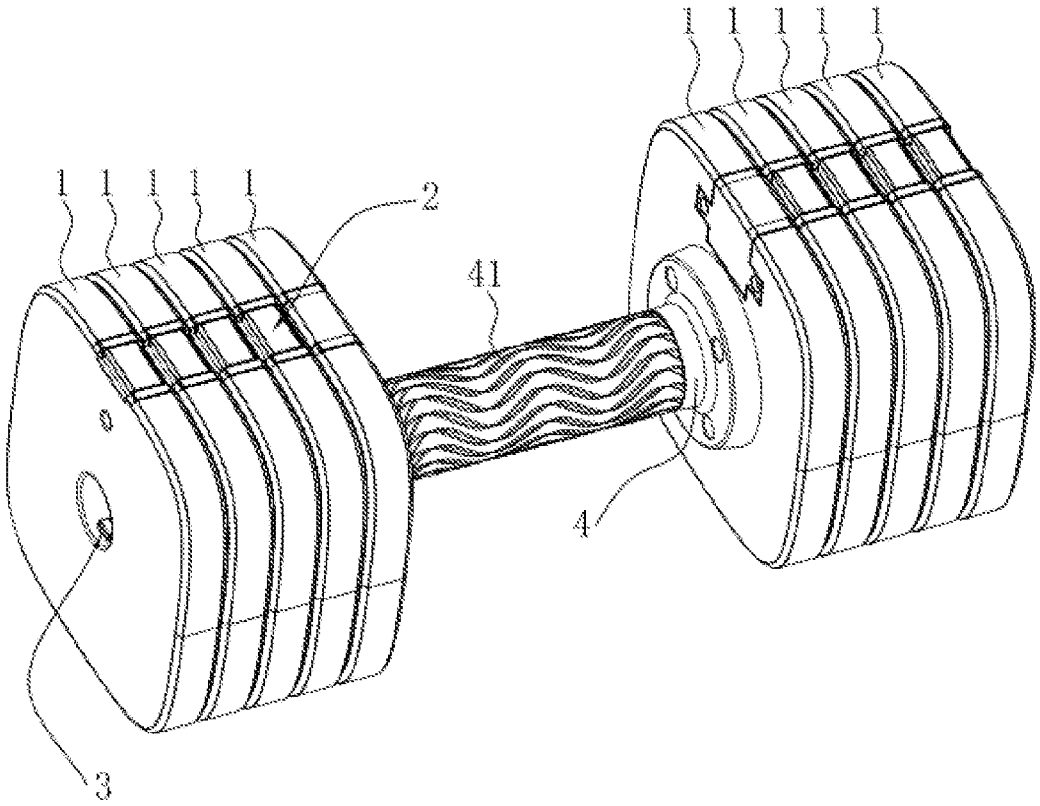
FIG. 8 is a structural diagram of the dumbbell of the present application.

Referring to FIG. 8, a weight adjustable dumbbell includes a dumbbell bar 4 and the weight plate described above, the dumbbell bar 4 is in a long-shape bar, the dumbbell bar 4 is fixed set with an anti-skid sheath 41, a plurality of weight plates are arranged along a length direction of the dumbbell bar 4 and symmetrically arranged at both ends of the dumbbell bar 4 in the length direction, and the weight plates at both ends of the dumbbell bar 4 in the length direction are fixedly connected with the dumbbell bar 4. Two adjacent weight plates are detachably connected through a limiting assembly 2 and an engaging assembly 3.

When in use, two weight plates are fixedly connected to both ends of the dumbbell bar 4, and then a plurality of weight plates are symmetrically and detachably connected to the weight plates at both ends of the dumbbell bar 4 through the limiting assembly 2 and the engaging assembly 3, thereby the weight of the dumbbell can be adjusted, thereby facilitate the user to adjust the weight of the dumbbell, Thereby users do not need to buy a plurality of dumbbells of different weights.

The embodiment of the present application also discloses a barbell with adjustable weight.

Referring to FIG. 9, a weight adjustable barbell includes a barbell bar 5 and the weight plate described above. The barbell bar 5 is in a long-shape bar. A plurality of weight plates are arranged along a length direction of the barbell bar 5 and symmetrically arranged at both ends of the barbell bar 5 in the length direction. The weight plates at both ends of the barbell bar 5 in the length direction are fixedly connected with the barbell bar 5. Two adjacent weight plates are detachably connected through a limiting assembly 2 and an engaging assembly 3.

In use, two weight plates are fixedly connected to both ends of the barbell bar 5, and then a plurality of weight plates are symmetrically and detachably connected to the weight plates at both ends of the barbell bar 5 through the limiting assembly 2 and the engaging assembly 3, thereby the weight of the barbell can be adjusted conveniently, which is convenient for users to adjust the weight of the barbell, making the use of the barbell more conveniently and quickly.

The above are the preferred embodiments of the present application and do not limit the scope of protection of the present application. Therefore, all equivalent changes made according to the structure, shape and principle of the present application shall be covered by the scope of protection of the present application.

What is claimed is:

1. A combinable weight plate, comprising: a plate body, a limiting assembly and an engaging assembly, wherein a circular central hole is formed on one side of the plate body, the engaging assembly comprises at least one fixture block and a cylindrical engaging head, the at least one fixture block is fixedly arranged on an inner wall of the circular central hole, the cylindrical engaging head is fixedly connected on a side of the plate body away from the circular central hole, and at least one engaging block corresponding to the at least one fixture block is fixedly arranged on a side wall of the cylindrical engaging head, the cylindrical engaging head is configured to be inserted into a central hole of an adjacent weight plate, and when the cylindrical engaging head rotates in the central hole of the adjacent weight plate, the cylindrical engaging head abuts a side of at least one fixture block facing an interior of the central hole of the adjacent weight plate by means of the at least one engaging block;

the limiting assembly comprises a sliding block, wherein the sliding block is slidably arranged in the plate body along a thickness direction of the plate body, a limiting block protruding from a side wall of the plate body is fixedly arranged at one end of the sliding block in a sliding direction, an engaging groove corresponding to the limiting block is formed on one side of the plate body away from the limiting block, an elastic part is arranged on the plate body, and the limiting block engages in an engaging groove of the adjacent weight plate all the time by means of the elastic part when the combinable weight plate is connected to the adjacent weight plate.

2. The combinable weight plate according to claim 1, wherein a button is slidably connected to the plate body, a sliding direction of the button is perpendicular to the sliding direction of the sliding block, one end of the button in the sliding direction of the button is arranged in the plate body, a second end of the button extends out of the side wall of the plate body, a third end of the button close to the sliding block forms an inclined surface and abuts against the sliding block, and when the button slides towards the sliding block, the button pushes the sliding block to slide towards an end away from the limiting block.

3. The combinable weight plate according to claim 2, wherein the elastic part comprises a first spring and a second spring, the first spring is fixedly arranged between the sliding block and the plate body, the first spring is arranged along the sliding direction of the sliding block, the second spring is fixedly arranged between the button and the plate body, and the second spring is arranged along the sliding direction of the button.

4. The combinable weight plate according to claim 2, wherein each of two sides of the button in the sliding direction of the sliding block extends to form a protrusion such that there are two protrusions, two stop blocks corresponding to the two protrusions are fixedly arranged on two sides, along the sliding direction of the button, of a limit cover, and the two stop blocks abut against sides of the two protrusions away from the sliding block.

5. The combinable weight plate according to claim 1, wherein a button is slidably connected to the plate body, a sliding direction of the button is perpendicular to the sliding direction of the sliding block, one end of the button in the sliding direction of the button is arranged in the plate body, a second end of the button extends out of the side wall of the plate body, a sliding slot is formed in the button, an end of the sliding slot close to the sliding block is inclined towards a side of the sliding block close to the limiting block, a cylindrical pin is slidably connected in the sliding slot, the cylindrical pin is fixedly connected to the sliding block, the elastic part comprises a first spring that is fixedly arranged between the button and the plate body, and the first spring is arranged along the sliding direction of the button.

6. The combinable weight plate according to claim 1, wherein the at least one fixture block comprises a plurality of fixture blocks arranged along a circumferential direction of the circular central hole, the at least one engaging block comprises a plurality of engaging blocks arranged along a circumferential direction of the cylindrical engaging head, the plurality of engaging blocks is in one-to-one correspondence with the plurality of fixture blocks, and each of the plurality of engaging blocks is able to pass through a gap between two adjacent fixture blocks of the adjacent weight plate.

7. The combinable weight plate according to claim 1, wherein a guide groove is formed on each of two sides of the sliding block in the sliding direction such that there are two guide grooves, each of the two guide grooves extends through two end faces of the sliding block in the sliding direction, a guide block is arranged in the two guide grooves, the guide block is fixedly arranged on the plate body, and the sliding block is slidably connected to the guide block.

* * * * *